US010629145B2

(12) United States Patent
Du

(10) Patent No.: US 10,629,145 B2
(45) Date of Patent: Apr. 21, 2020

(54) ARRAY SUBSTRATE FOR LOWERING SWITCH FREQUENCY OF DRIVE POLARITY IN DATA LINES

(71) Applicant: Shenzhen China Star Optoelectronics Technology Co., Ltd., Shenzhen (CN)

(72) Inventor: Peng Du, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 595 days.

(21) Appl. No.: 14/906,560

(22) PCT Filed: Dec. 30, 2015

(86) PCT No.: PCT/CN2015/099662
§ 371 (c)(1),
(2) Date: Jan. 21, 2016

(87) PCT Pub. No.: WO2017/088264
PCT Pub. Date: Jun. 1, 2017

(65) Prior Publication Data

US 2017/0154588 A1 Jun. 1, 2017

(30) Foreign Application Priority Data

Nov. 26, 2015 (CN) ..... 2015 1 0837578

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01);
(Continued)

(58) Field of Classification Search
None
See application file for complete search history.

(56) References Cited

U.S. PATENT DOCUMENTS 6,552,707 B1 * 4/2003 Fujiyoshi ..... G09G 3/3648 345/100
9,263,477 B1 * 2/2016 Du ..... H01L 33/38
(Continued)

FOREIGN PATENT DOCUMENTS

CN 101042479 9/2007
CN 101566744 10/2009
(Continued)

OTHER PUBLICATIONS

Notification of Office Action dated Jun. 7, 2017 From the State Intellectual Property Office of the People's Republic of China Re. Application No. 2017060201480840. (5 Pages).

*Primary Examiner* — William Boddie
*Assistant Examiner* — Bipin Gyawali

(57) ABSTRACT

An array substrate for lowering switch frequency of drive polarity in data lines is described. The source driver charges a first sub-pixel group having the first polarity on pixel regions wherein the first sub-pixel group comprises a plurality of sub-pixels with the positive polarity disposed in the interlaced positions between data line and the scan lines. The source driver charges a second sub-pixel group having the second polarity on the pixel regions wherein the second sub-pixel group comprises a plurality of sub-pixels with the negative polarity disposed in the interlaced positions between data line and the scan lines. The first sub-pixel group is greater than each pixel region and the second sub-pixel group is greater than each pixel region so that either the switch frequency for driving the first sub-pixel group or the second sub-pixel group is lower than that of the two sub-pixels in the pixel region.

6 Claims, 4 Drawing Sheets

(52) U.S. Cl.
CPC ..... *G09G 2300/0426* (2013.01); *G09G 2300/0452* (2013.01); *G09G 2310/0224* (2013.01); *G09G 2310/0251* (2013.01); *G09G 2310/06* (2013.01); *G09G 2330/021* (2013.01)

(56) References Cited

U.S. PATENT DOCUMENTS

| | | | | |
|---|---|---|---|---|
| 10,014,328 | B2 * | 7/2018 | Chen | G02F 1/1362 |
| 2007/0216632 | A1 | 9/2007 | Lee | |
| 2009/0322666 | A1 | 12/2009 | Hsu | |
| 2010/0110114 | A1 * | 5/2010 | Hashimoto | G09G 3/3614 345/691 |
| 2011/0115998 | A1 * | 5/2011 | Liao | G02F 1/136213 349/38 |
| 2011/0285950 | A1 * | 11/2011 | Su | G02F 1/136286 349/139 |
| 2012/0120034 | A1 * | 5/2012 | Lee | G09G 3/3677 345/205 |
| 2015/0170590 | A1 * | 6/2015 | Ahn | G09G 3/3614 345/96 |
| 2015/0379947 | A1 * | 12/2015 | Sang | G09G 3/3614 349/37 |
| 2016/0334684 | A1 * | 11/2016 | Li | G02F 1/133514 |
| 2017/0032749 | A1 | 2/2017 | Liu et al. | |
| 2017/0103695 | A1 * | 4/2017 | Nishimura | G09G 3/2018 |
| 2017/0345382 | A1 * | 11/2017 | Sang | G02F 1/13 |

FOREIGN PATENT DOCUMENTS

| | | |
|---|---|---|
| CN | 101726898 | 6/2010 |
| CN | 103514846 | 1/2014 |
| CN | 105093737 | 11/2015 |

* cited by examiner

ARRAY SUBSTRATE FOR LOWERING SWITCH FREQUENCY OF DRIVE POLARITY IN DATA LINES

RELATED APPLICATIONS

This application is a National Phase of PCT Patent Application No. PCT/CN2015/099662 having International filing date of Dec 30, 2015, which claims the benefit of priority of Chinese Patent Application No. 201510837578.7 filed on Nov 26, 2015. The contents of the above applications are all incorporated by reference as if fully set forth herein in their entirety.

FIELD AND BACKGROUND OF THE INVENTION

The present invention relates to a technical field of a liquid crystal display (LCD), and more particularly to an array substrate for lowering switch frequency of drive polarity in the data lines wherein the array substrate decreases the switch frequency of positive polarity and negative polarity in the data lines in order to effectively reduce the power consumption of a display panel and comply with current environmental requirements when the LCD implements dot-inversion within the display panel.

Since the LCD is provided with the features of low radiation, small size and low power consumption for consumers, therefore, the conventional display unit with cathode ray tube is increasingly replaced by the LCD. An LCD panel is widely used in communication products including a notebook computer, a personal digital assistant (PDA), a flat panel television and mobile phone.

Conventionally, a manufacturing cost reduction is a critical issue during the LCD's manufacturing procedure. A data line sharing (DLS) mechanism is commonly used wherein the number of gate lines is doubled and the number of data lines is halved to diminish the amount of source driver and thus reduce the costs.

When driving the LCD panel, the dot-inversion manner is an inversion mechanism for better display quality. If the DLS mechanism is adopted in a specific resolution, e.g. high definition (HD) with 1366*768 pixels, and a refresh rate, e.g. 60 Hz (hertz), it is required to switch the signal polarities of the data lines at a time for every two pixels when the display panel is operated. In other words, the switch period of the drive polarities in the data lines is equal to 21.7 μs (micro-second), which is computed by a formula 1/(60*768), at a time and the corresponding switch frequency in the data line is about 20 kHz. If this manner is used, on one hand, the power consumption of the data lines is increased and on the other hand, the charging time of the pixels in the DLS mechanism is very short. Furthermore, the resistance/capacitance (RC) delay of the signal switch will affect the charging procedure of the DLS mechanism, which may downgrade the display quality. If the LCD's resolution is increased, it aggravates the problem of charging procedure of the DLS mechanism. Consequently, there is a need to develop a novel array substrate to solve the problems of the conventional technique.

SUMMARY OF THE INVENTION

Therefore, one objective of the present invention is to provide an array substrate for lowering a switch frequency of a drive polarity in the data lines wherein the array substrate decreases the switch frequency of positive polarity and negative polarity in the data lines in order to reduce the power consumption of the display panel and comply with current environmental requirements when the LCD implements dot-inversion within the display panel.

Based on the above objective, the present invention sets forth an array substrate for lowering a switch frequency of a drive polarity in data lines according to a first embodiment of the present invention. The array substrate which is applicable to a liquid crystal display (LCD) comprises: a gate driver having a plurality of gate contact portions, for generating a plurality of scan signals; a source driver, for generating a plurality of data signals; a plurality of scan lines electrically coupled to the gate contact portions of the gate driver, for correspondingly receiving the scan signals wherein an amount of the gate contact portions is the same as that of the scan lines and the gate contact portions corresponds to the scan lines respectively; and a plurality of data lines electrically coupled to source driver, for receiving the data signals; wherein the scan lines and the data lines are insulatedly interlaced in an array with a column and row arrangement to form a plurality of pixel regions, each pixel region comprises a data line and two scan lines, and each pixel region is composed of two sub-pixels with different color types and the two sub-pixels comprises a first polarity and a second polarity which is different from the first polarity; wherein a portion of gate contact portions are correspondingly and electrically coupled to a portion of scan lines, another portion of gate contact portions are interlacedly and electrically coupled to another portion of scan lines correspondingly so that the source driver is capable of charging a first sub-pixel group having the first polarity on the pixel regions of each data line wherein the first sub-pixel group comprises a plurality of sub-pixels with the positive polarity disposed in the interlaced positions between data line and the scan lines respectively, and the source driver is capable of charging a second sub-pixel group having the second polarity on the pixel regions of each data line wherein the second sub-pixel group comprises a plurality of sub-pixels with the negative polarity disposed in the interlaced positions between data line and the scan lines respectively; wherein a sub-pixel amount of the first sub-pixel group is greater than the sub-pixels in each pixel region and a sub-pixel amount of the second sub-pixel group is greater than the sub-pixels in each pixel region so that either the switch frequency for driving the first sub-pixel group or the switch frequency for driving the second sub-pixel group is lower than that of the two sub-pixels corresponding to the pixel region.

In embodiment, the drive polarity of a predetermined sub-pixel is different from the drive polarities of the sub-pixels surrounding the predetermined sub-pixel respectively.

In embodiment, either the first polarity and the second polarity are a positive polarity and a negative polarity respectively or the first polarity and the second polarity are the negative polarity and the positive polarity respectively.

In embodiment, two sub-pixels having two different color types respectively are selected from one group consisting of the sub-pixels with blue color, green color and red color.

In embodiment, two sub-pixels having two different color types respectively are selected from one group consisting of the sub-pixels with white color, blue color, green color and red color.

In embodiment, a plurality of serial numbers of the gate contact portions in the gate driver are G0, G1, G2, . . . and Gn respectively, a plurality of serial numbers of the scan lines are GL0, GL1, GL2, . . . and GLn, and "n" is a positive integer, and wherein the gate contact portions G(8k+2), G(8k+3), G(8k+4) and G(8k+5) are interlacedly and electrically connected to the scan lines GL(8k+4), GL(8k+5), GL(8k+2) and GL(8k+3) correspondingly and "k" is an integer.

In embodiment, the gate contact portions G(8k), G(8k+1), G(8k+6) and G(8k+7) are directly and electrically connected to the scan lines GL(8k), GL(8k+1), GL(8k+6) and GL(8k+7) correspondingly and "k" is an integer.

BRIEF DESCRIPTION OF THE SECERAL VIEWS OF THE DRAWINGS

DESCRIPTION OF SPECFIC EMBODIMENTS OF THE INVENTION

Figure 1A:
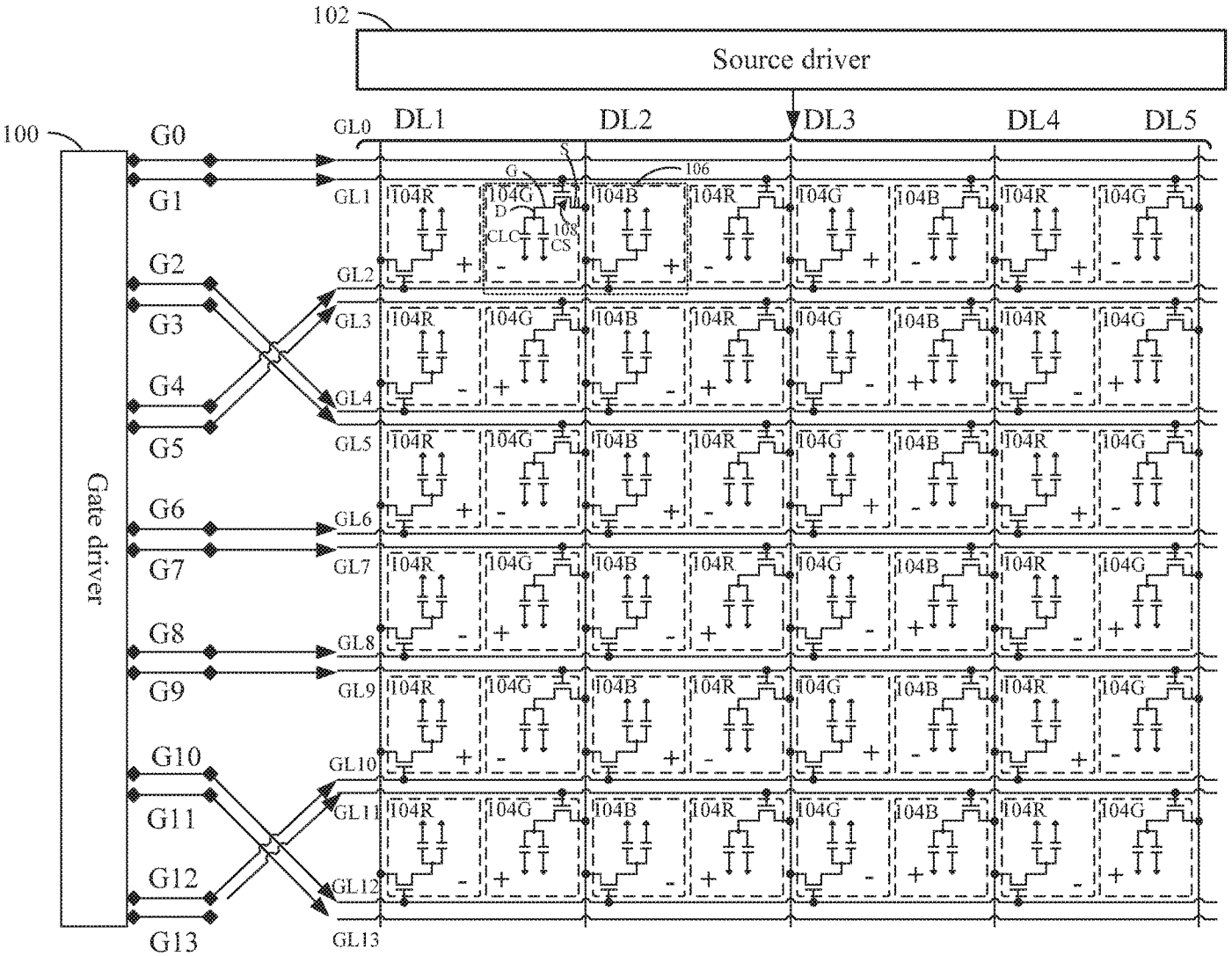
FIG. 1A is a schematic circuit of an array substrate for lowering switch frequency of drive polarity in the data lines according to a first embodiment of the present invention.

The following embodiments refer to the accompanying drawings for exemplifying specific implementable embodiments of the present invention. Furthermore, directional terms described by the present invention, such as upper, lower, front, back, left, right, inner, outer, side, etc., are only directions by referring to the accompanying drawings, and thus the used directional terms are used to describe and understand the present invention, but the present invention is not limited thereto. In the drawings, the same reference symbol represents the same or a similar component.

Figure 1B:
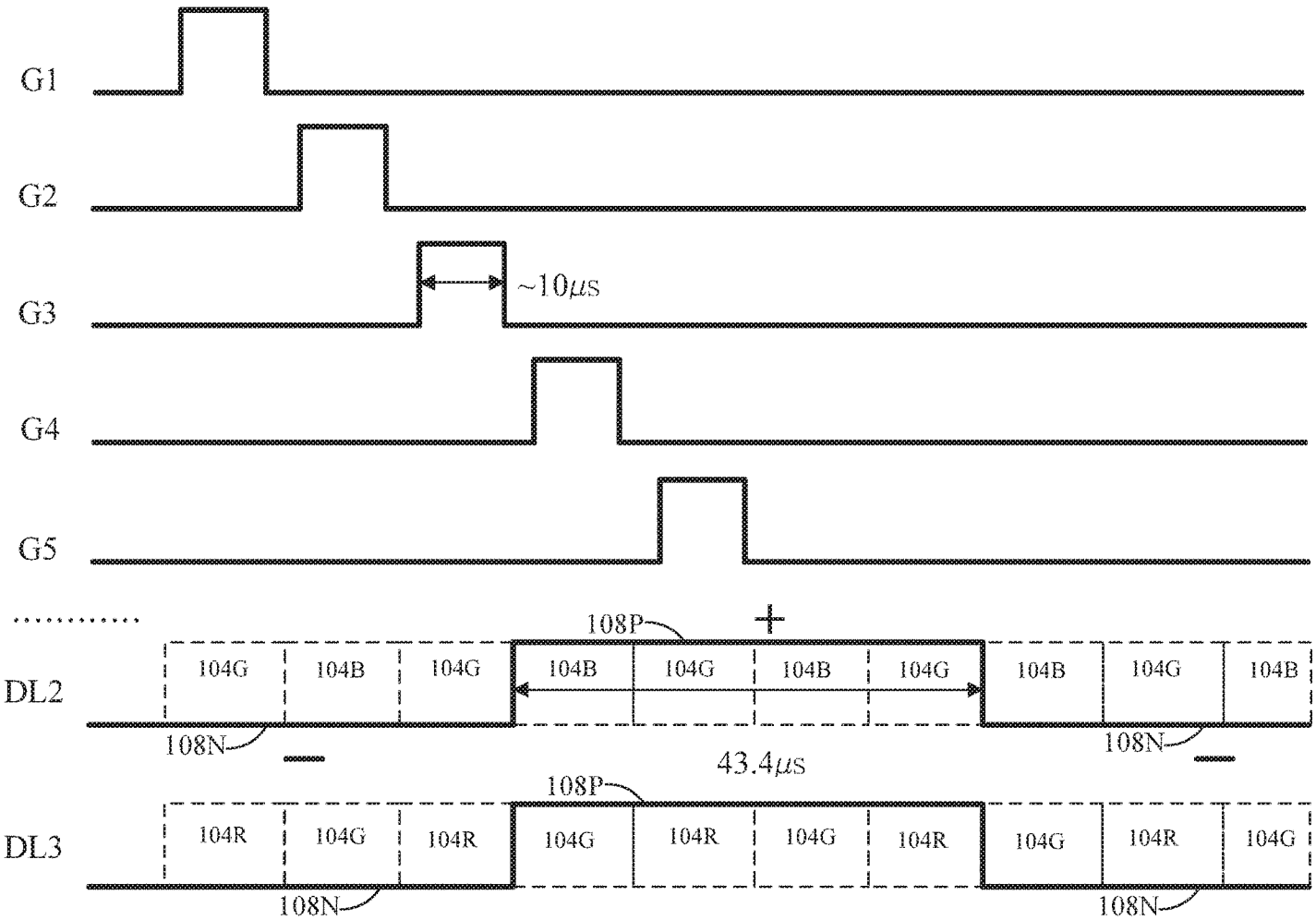
FIG. 1B is a schematic drive timing waveform of scan lines and data lines on the array substrate according to the first embodiment of the present invention.

Please refer to FIGS. 1A and 1B. FIG. 1A is a schematic circuit of an array substrate for lowering switch frequency of drive polarity in the data lines according to a first embodiment of the present invention. FIG. 1B is a schematic drive timing waveform of scan lines and data lines on the array substrate according to the first embodiment of the present invention. The array substrate applicable to LCD panel uses a data line sharing (DLS) mechanism. The array substrate comprises a gate driver 100, a source driver 102, a plurality of scan lines GL0 to GL13, a plurality of data lines DL1 to DL5 and a plurality of pixels 104B, 104G, 104R. In FIG. 1A, there are fourteen scan lines and five data lines, but not limited. For example, more than fourteen scan lines and five data lines are provided.

As shown in FIGS. 1A and 1B, the gate driver 100 comprises a plurality of gate contact portions G0 to G13 for generating a plurality of scan signals. The source driver 102 is used to generate a plurality of data signals. A plurality of scan lines GL0 to GL13 are electrically coupled to the gate contact portions G0 to G13 in the gate driver 100 for correspondingly receiving the scan signals wherein an amount of the gate contact portions G0 to G13 is the same as that of scan lines GL0 to GL13 and the gate contact portions G0 to G13 corresponds to the scan lines GL0 to GL13 respectively. The plurality of data lines DL1 to DL5 are electrically coupled to the source driver 102 for receiving the data signals.

In FIGS. 1A and 1B, the scan lines GL0 to GL13 and the data lines DL1 to DL5 are insulatedly interlaced in an array with a column and row arrangement to form a plurality of pixel regions 106. Each pixel region 106 comprises a data line (one of DL1 to DL5) and two scan lines, e.g. a pair of scan lines GL1 and GL2 or a pair scan lines of GL3 and GL4. Each pixel region 106 is composed of two sub-pixels 104B, 104G, 104R with different color types and the two sub-pixels 104B, 104G, 104R comprises a first polarity 108P and a second polarity 108N which is different from the first polarity 108P. A portion of gate contact portions G0 to G13 are correspondingly and electrically coupled to a portion of scan lines GL0 to GL13. Another portion of gate contact portions G0 to G13 are interlacedly and electrically coupled to another portion of scan lines GL0 to GL13 correspondingly. Thus, the source driver 102 is capable of charging the first sub-pixel group having the first polarity 108P on the pixel regions of each data line DL1 to DL15 wherein the first sub-pixel group comprises a plurality of sub-pixels with the positive polarity disposed in the interlaced positions between data line, e.g. DL2, and the scan lines GL2, GL3, GL6, GL7 respectively. The source driver 102 is capable of charging the second sub-pixel group having the second polarity 108N on the pixel regions of each data line DL1 to DL15 wherein the second sub-pixel group comprises a plurality of sub-pixels with the negative polarity disposed in the interlaced positions between data line, e.g. DL2, and the scan lines GL1, GL4, GL5, GL8 respectively. The sub-pixel amount of the first sub-pixel group is greater than the sub-pixels 104B, 104G, 104R in each pixel region 106 and the sub-pixel amount of the second sub-pixel group is greater than the sub-pixels 104B, 104G, 104R in each pixel region 106 so that either the switch frequency for driving the first sub-pixel group, e.g. having four sub-pixels, or the switch frequency for driving the second sub-pixel group, e.g. having four sub-pixels, is lower than that of the two sub-pixels corresponding to a pixel region 106.

As shown in one embodiment of FIGS. 1A and 1B, the drive polarity of a predetermined sub-pixel 104B, 104G, or 104R is different from the drive polarities of the sub-pixels 104B, 104G, 104R surrounding the predetermined sub-pixel respectively. Preferably, the drive polarity of the predetermined sub-pixel 104B, 104G, or 104R is opposite to the drive polarities of the sub-pixels 104B, 104G, 104R surrounding the predetermined sub-pixel respectively to form the display panel with data line sharing mechanism. In one case, the first polarity and the second polarity are a positive polarity "+" and a negative polarity "−" respectively. In another case, the first polarity and the second polarity are the negative polarity "−" and the positive polarity "+" respectively. In one embodiment, the two sub-pixels having two different color types respectively are selected from one group consisting of the sub-pixels with blue color, green color and red color.

In FIGS. 1A and 1B, taking an example of a display panel with high definition (HD), the serial numbers of the gate contact portions in the gate driver 100 are G0, G1, G2, . . . and Gn respectively, the serial numbers of the scan lines are GL0, GL1, GL2, . . . and GLn, wherein "n" is a positive integer. The gate contact portions G(8k+2), G(8k+3), G(8k+4) and G(8k+5) are interlacedly and electrically connected to the scan lines GL(8k+4), GL(8k+5), GL(8k+2) and GL(8k+3) correspondingly wherein "k" is an integer; in other words, for a set of eight gate contact portions G0, G1, G2, . . . and G7, four gate contact portions in the gate driver 100 are interlacedly and electrically coupled to the scan lines in the display panel by mapping the different serial numbers of the gate contact portions and the scan lines, as shown in FIG. 1A. The gate contact portions G(8k), G(8k+1), G(8k+6) and G(8k+7) are directly and electrically connected to the scan lines GL(8k), GL(8k+1), GL(8k+6) and GL(8k+7) correspondingly wherein "k" is an integer; in other words, for the set of eight gate contact portions G0, G1, G2, . . . and G7, another four gate contact portions in the gate driver 100 are directly and electrically coupled to the scan lines in the display panel by mapping the same serial numbers of the gate contact portions and the scan lines, as shown in FIG. 1A.

As shown in FIGS. 1A and 1B, when the display panel is operated, the gate driver 100 sequentially turns on the gate contact portions G0, G1, G2, G3, . . . and Gn, and for example, a pulse width 10 μs corresponds to a charging pulse width of a sub-pixel with respect to one data line. In other words, after the data line charges four sub-pixels, i.e. every four charging pulse widths, the drive polarity of the sub-pixel group is switched from the first polarity to second polarity and vice versa. In one embodiment of FIG. 1A, taking an example of data line DL2, the polarities of sub-pixels corresponding to the gate contact portions G(8k), G(8k+1), G(8k+2) and G(8k+3) are negative polarities, and the polarities of sub-pixels corresponding to the gate contact portions G(8k+4), G(8k+5), G(8k+6) and G(8k+7) are positive polarities so that the drive polarity of the sub-pixel group is switched from the first polarity to second polarity after every 43.4 μs, i.e. computed by formula (1/(60*768)*2), which is longer than the conventional 21.7 μs in view of the same resolution condition. In comparison to the conventional DLS mechanism, the switch frequency of the drive polarity in the data lines is halved. For an example of high definition (HD) 1366*768 (pixels) and a refresh rate, e.g. 60 Hz (hertz) during one display frame, the switch frequency of polarities is 384 times. Since the power consumption of the data lines is positively related to the frequency squared, the power consumption of the display panel is effectively decreased to comply with current environmental requirements when the switch frequencies of the data lines are reduced.

These sub-pixels 104B, 104G, 104R are electrically coupled to the scan lines GL and data lines DL. Each of the sub-pixels 104B, 104G, 104R has a transistor 108, a liquid-crystal capacitor (CLC) and a storage capacitor (CS) wherein the transistor 108 has a gate electrode G, a source electrode S and a drain electrode D. The gate electrode G is connected to the scan line GL, the source electrode S is connected to the data line DL, and the drain electrode D is commonly connected to the CLC and the CS (not shown) or commonly connected to the common line (not shown). When a positive voltage is applied to the scan line GL, the thin film transistor 108 connected to the scan line turns on so that the sub-pixel electrodes of the CLC are electrically connected to the data lines DL and the video signal is transmitted to the sub-pixel electrode via the data lines correspondingly for charging the CLC to be a proper voltage level. In other words, the CLC of the sub-pixel is charged to drive the liquid crystal molecules within the liquid crystal layer for displaying the image on the LCD panel. Meanwhile, the CSs connected to the data lines DL are charged wherein the charged CSs are used to maintain the voltage potential of the CLC to be a predetermined value for keeping the voltage potential to be constant in the both terminals of the CLC by the charged CSs before the data lines are updated.

Figure 2A:
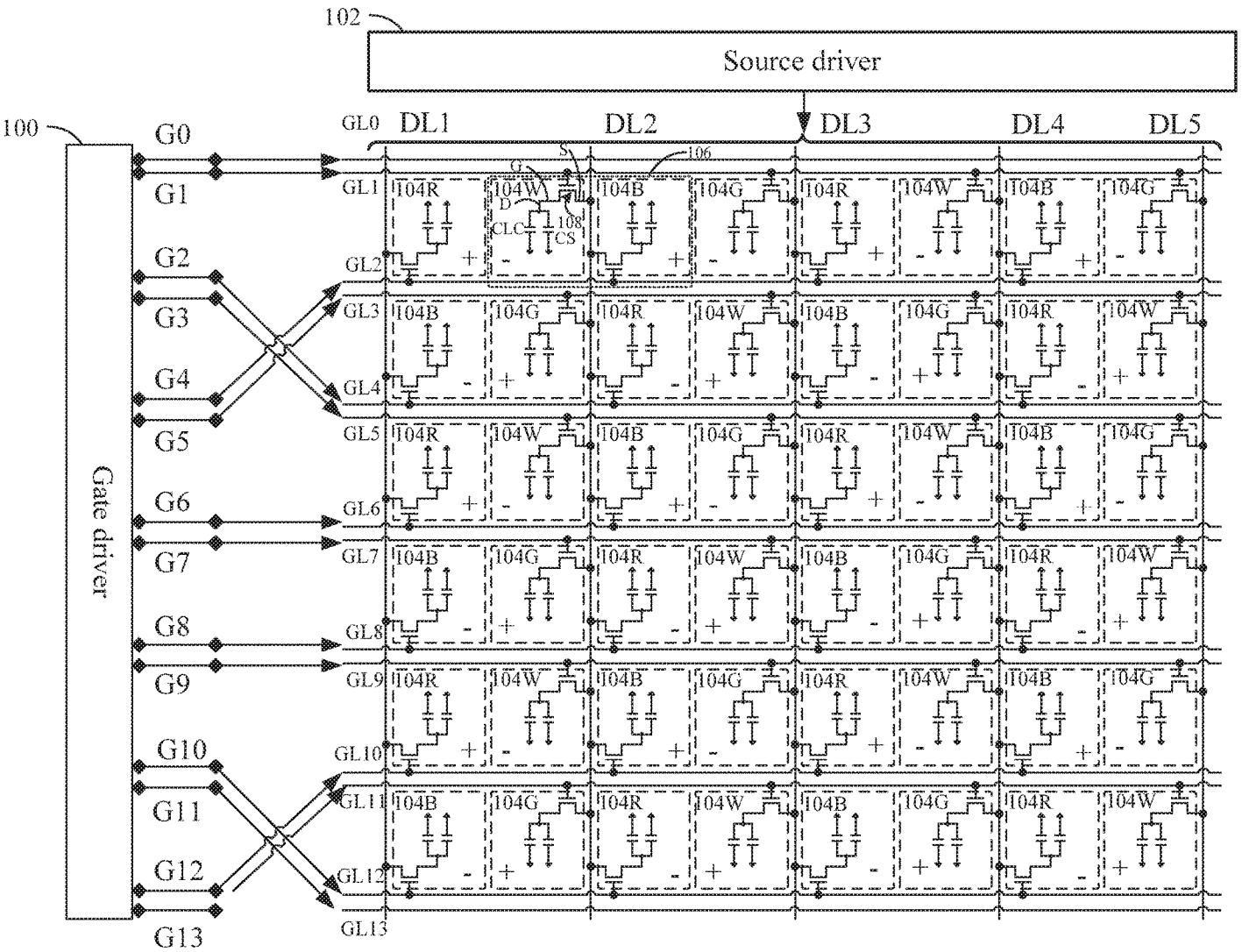
FIG. 2A is a schematic circuit of an array substrate for lowering switch frequency of drive polarity in the data lines according to a second embodiment of the present invention.
Figure 2B:
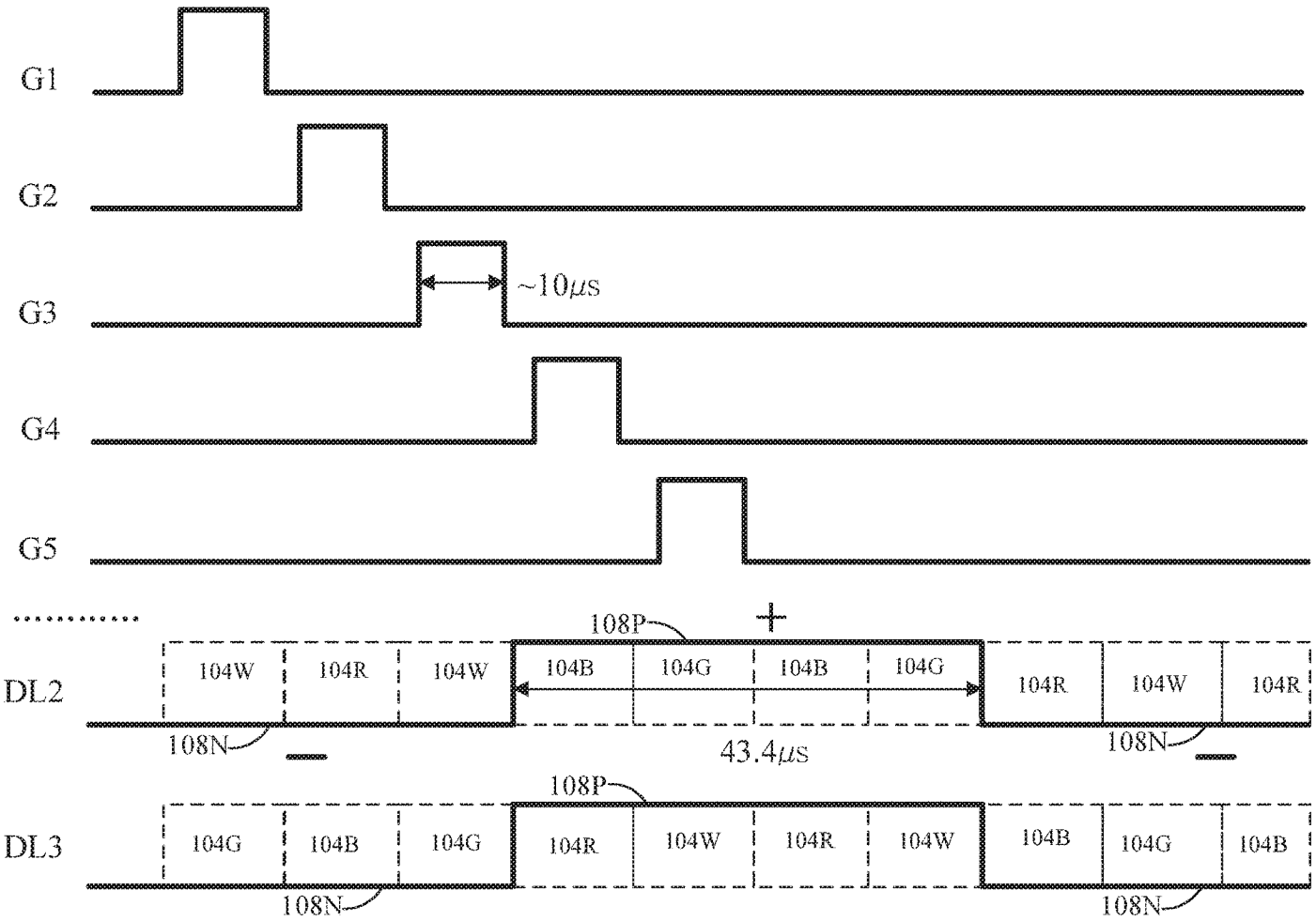
FIG. 2B is a schematic drive timing waveform of scan lines and data lines on the array substrate according to the second embodiment of the present invention.

Please refer to FIGS. 2A and 2B. FIG. 2A is a schematic circuit of an array substrate for lowering switch frequency of drive polarity in the data lines according to a second embodiment of the present invention. FIG. 2B is a schematic drive timing waveform of scan lines and data lines on the array substrate according to the second embodiment of the present invention. The array substrate for lowering switch frequency of drive polarity in the data lines in the second embodiment is similar to that in the first embodiment. The difference between is that the two sub-pixels having two different color types respectively are selected from one group consisting of the sub-pixels 104W, 104B, 104G, 104R with white color, blue color, green color and red color.

As shown in one embodiment of FIGS. 2A and 2B, the drive polarity of a predetermined sub-pixel 104W, 104B, 104G, or 104R is different from the drive polarities of the sub-pixels 104W, 104B, 104G, 104R surrounding the predetermined sub-pixel respectively. Preferably, the drive polarity of the predetermined sub-pixel 104W, 104B, 104G, or 104R is opposite to the drive polarities of the sub-pixels 104W, 104B, 104G, 104R surrounding the predetermined sub-pixel respectively to form the display panel with data line sharing (DLS) mechanism. In one case, the first polarity and the second polarity are a positive polarity "+" and a negative polarity "−" respectively. In another case, the first polarity and the second polarity are the negative polarity "−" and the positive polarity "+" respectively. In one embodiment, the two sub-pixels having two different color types respectively are selected from one group consisting of the sub-pixels with blue color, green color and red color.

In FIGS. 2A and 2B, taking an example of a display panel with high definition (HD), the serial numbers of the gate contact portions in the gate driver 100 are G0, G1, G2, . . . and Gn respectively, the serial numbers of the scan lines are GL0, GL1, GL2, . . . and GLn, wherein "n" is a positive integer. The gate contact portions G(8k+2), G(8k+3), G(8k+4) and G(8k+5) are interlacedly and electrically connected to the scan lines GL(8k+4), GL(8k+5), GL(8k+2) and GL(8k+3) correspondingly wherein "k" is an integer; in other words, for a set of eight gate contact portions G0, G1, G2, . . . and G7, four gate contact portions in the gate driver 100 are interlacedly and electrically coupled to the scan lines in the display panel by mapping the different serial numbers of the gate contact portions and the scan lines, as shown in FIG. 2A. The gate contact portions G(8k), G(8k+1), G(8k+6) and G(8k+7) are directly and electrically connected to the scan lines GL(8k), GL(8k+1), GL(8k+6) and GL(8k+7) correspondingly wherein "k" is an integer; in other words, for the set of eight gate contact portions G0, G1, G2, . . . and G7, another four gate contact portions in the gate driver 100 are directly and electrically coupled to the scan lines in the display panel by mapping the same serial numbers of the gate contact portions and the scan lines, as shown in FIG. 2A.

As shown in FIGS. 2A and 2B, when the display panel is operated, the gate driver 100 sequentially turns on the gate contact portions G0, G1, G2, G3, . . . and Gn, and for example, a pulse width 10 μs corresponds to a charging pulse width of a sub-pixel with respect to one data line. In other words, after the data line charges four sub-pixels, i.e. every four charging pulse widths, the drive polarity of the sub-pixel group is switched from the first polarity to second polarity and vice versa based on the every four charged sub-pixels. In one embodiment of FIG. 2A, taking an example of data line DL2, the polarities of sub-pixels corresponding to the gate contact portions G(8k), G(8k+1), G(8k+2) and G(8k+3) are negative polarities, and the polarities of sub-pixels corresponding to the gate contact portions G(8k+4), G(8k+5), G(8k+6) and G(8k+7) are positive polarities so that the drive polarity of the sub-pixel group is switched from the first polarity to second polarity after every 43.4 μs, i.e. computed by formula (1/(60*768)*2), which is longer than the conventional 21.7 μs in view of the same resolution condition. In comparison to the conventional technique, the switch frequency of the data lines is halved. For an example of high definition (HD) 1366*768 pixels and a refresh rate, e.g. 60 Hz (hertz), during one display frame, the switch frequency of polarities is 384 times. Since the power consumption of the data lines is positively related to the frequency squared, the power consumption of the display panel is effectively decreased to comply with current environmental requirements when the switch frequencies of the data lines are reduced.

According to the above-mentioned descriptions, the array substrate for lowering a switch frequency of a drive polarity in the data lines in the present invention improves the DLS mechanism for the driving method of the LCD panel. Based on the dot-inversion, the array substrate of the present invention is capable of lowering the switch frequency of the drive polarity in the data lines to reduce the power consumption of the display panel. Furthermore, the array substrate also improves the charging status of the sub-pixels. In comparison to the conventional DLS mechanism, the switch frequency of the drive polarity in the data lines is halved. For an example of high definition (HD) 1366*768 (pixels) and a refresh rate, e.g. 60 Hz (hertz) during one display frame, the switch frequency of polarities is 384 times. For example, after the data line charges four sub-pixels, i.e. every four charging pulse widths, the drive polarity of the sub-pixel group is switched from the first polarity to second polarity and vice versa based on the every four charged sub-pixels.

As is understood by a person skilled in the art, the foregoing preferred embodiments of the present invention are illustrative rather than limiting of the present invention. It is intended that they cover various modifications and similar arrangements be included within the spirit and scope of the present invention, the scope of which should be accorded the broadest interpretation so as to encompass all such modifications and similar structures.

What is claimed is:

1. An array substrate for lowering a switch frequency of a drive polarity in data lines, which is applicable to a liquid crystal display (LCD), the array substrate comprising:

a gate driver having a plurality of gate contact portions, for generating a plurality of scan signals;

a source driver, for generating a plurality of data signals;

a plurality of scan lines electrically coupled to the gate contact portions of the gate driver, for correspondingly receiving the scan signals wherein an amount of the gate contact portions is the same as that of the scan lines and the gate contact portions corresponds to the scan lines respectively; and a plurality of data lines electrically coupled to source driver, for receiving the data signals;

wherein the scan lines and the data lines are insulatedly interlaced in an array with a column and row arrangement to form a plurality of pixel regions, each pixel region comprises a data line and two scan lines, and each pixel region is composed of two sub-pixels with different color types and the two sub-pixels comprises a first polarity and a second polarity which is different from the first polarity;

wherein a portion of gate contact portions are correspondingly and electrically coupled to a portion of scan lines, another portion of gate contact portions are interlacedly and electrically coupled to another portion of scan lines correspondingly so that the source driver is capable of charging a first sub-pixel group having the first polarity on the pixel regions of each data line wherein the first sub-pixel group comprises a plurality of sub-pixels with the positive polarity disposed in the interlaced positions between data line and the scan lines respectively, and the source driver is capable of charging a second sub-pixel group having the second polarity on the pixel regions of each data line wherein the second sub-pixel group comprises a plurality of sub-pixels with the negative polarity disposed in the interlaced positions between data line and the scan lines respectively;

wherein a sub-pixel amount of the first sub-pixel group is greater than the sub-pixels in each pixel region and a sub-pixel amount of the second sub-pixel group is greater than the sub-pixels in each pixel region so that either the switch frequency for driving the first sub-pixel group or the switch frequency for driving the second sub-pixel group is lower than that of the two sub-pixels corresponding to the pixel region;

wherein the drive polarity of each of the two sub-pixels in each of the pixel regions is different from the drive polarity of each of the sub-pixels surrounding the each of the two sub-pixels;

wherein the sub-pixels in the same column are electrically coupled to the same one of the data lines.

2. The array substrate of claim 1, wherein either the first polarity and the second polarity are a positive polarity and a negative polarity respectively or the first polarity and the second polarity are the negative polarity and the positive polarity respectively.

3. The array substrate of claim 1, wherein two sub-pixels having two different color types respectively are selected from one group consisting of the sub-pixels with blue color, green color and red color.

4. The array substrate of claim 1, wherein two sub-pixels having two different color types respectively are selected from one group consisting of the sub-pixels with white color, blue color, green color and red color.

5. The array substrate of claim 1, wherein a plurality of serial numbers of the gate contact portions in the gate driver are G0, G1, G2, . . . and Gn respectively, a plurality of serial numbers of the scan lines are GL0, GL1, GL2, . . . and GLn, and "n" is a positive integer, and wherein the gate contact portions G(8k+2), G(8k+3), G(8k+4) and G(8k+5) are interlacedly and electrically connected to the scan lines GL(8k+4), GL(8k+5), GL(8k+2) and GL(8k+3) correspondingly and "k" is an integer.

6. The array substrate of claim 5, wherein the gate contact portions G(8k), G(8k+1), G(8k+6) and G(8k+7) are directly and electrically connected to the scan lines GL(8k), GL(8k+1), GL(8k+6) and GL(8k+7) correspondingly and "k" is an integer.

* * * * *